United States Patent [19]
Schauffele
[11] 4,246,515
[45] Jan. 20, 1981

[54] ENERGY-REGULATING FIRING CIRCUIT FOR AN ELECTRONIC STROBE FLASH UNIT

[75] Inventor: Carl N. Schauffele, Rochester, N.Y.

[73] Assignee: Eastman Kodak Company, Rochester, N.Y.

[21] Appl. No.: 58,962

[22] Filed: Jul. 20, 1979

[51] Int. Cl.³ ..... H05B 41/32

[52] U.S. Cl. ..... 315/290; 315/200 A; 315/209 R; 315/219; 315/276

[58] Field of Search ..... 315/200 A, 208, 241 P, 315/241 S, 244, 276, 289, 290, 209 R, 219; 328/67; 354/135, 142, 145; 431/357, 362, 365; 361/263

[56] References Cited

U.S. PATENT DOCUMENTS 2,071,370 2/1937 Williams et al. ..... 315/241 S
2,531,220 11/1950 Kaplan ..... 315/219
3,243,654 3/1966 Wright ..... 315/289

*Primary Examiner*—Eugene R. LaRoche
*Attorney, Agent, or Firm*—D. P. Monteith

[57] ABSTRACT

A battery-powered electronic strobe flash apparatus has a flashtube, which produces radiation in proportion to the energy delivered to it. A transformer has a primary winding, connectable to the battery, for storing energy in the transformer and a secondary winding, connected to the flashtube, for delivering the stored energy to the flashtube when the primary winding is disconnected from the battery. An actuatable switch has a first condition for connecting the battery to the primary winding to saturate the transformer, and a second condition for disconnecting the battery from the primary winding, thereby causing a substantially constant amount of energy to be delivered to the flashtube, whereby a substantially constant amount of flashtube radiation is produced each time the switch is actuated.

2 Claims, 3 Drawing Figures

ENERGY-REGULATING FIRING CIRCUIT FOR AN ELECTRONIC STROBE FLASH UNIT

BACKGROUND OF THE INVENTION

1. Field of the Invention

This invention relates to a battery-powered electronic strobe flash unit and, more particularly, to a simplified energy-regulating circuit for energizing a flashtube of the flash unit, the flashtube being energizable by a voltage that is greater than the battery's voltage.

2. Description of the Prior Art

In order to energize a flashtube of an electronic strobe flash unit, a relatively high voltage, termed the flashtube-breakdown voltage, is required. The breakdown voltage can be reduced when a trigger electrode is provided adjacent the outside of the flashtube, and a voltage pulse, commonly called a flashtube trigger pulse, is applied to the trigger electrode. Nevertheless, a voltage of approximately 300 volts is still required to fire the flashtube.

When the electronic strobe flash unit is powered by a battery having a voltage that is less than the flashtube-breakdown voltage, a DC to DC converter is used to develop the necessary voltage. Typically, a flash-firing capacitor is charged by the converter to store electrical energy used to produce a main flash of light by the flashtube. If a flashtube trigger electrode is provided, often a separate smaller capacitor, commonly called the flashtube trigger capacitor, is also charged by the converter, and provides a flashtube trigger pulse.

The flashtube of an electronic strobe flash unit emits an amount of radiation which is directly proportional to the amount of electrical energy dissipated in the flashtube. When an electronic strobe flash unit is used to illuminate a scene to be photographed, a flash-firing capacitor should be capable of storing enough electrical energy so that the flashtube can illuminate scenes which are at least about ten feet from the camera. This means that the flash-firing capacitor must store about 18 joules of energy to properly expose a photographic film of average light sensitivity.

However, there are strobe flash unit applications in which the amount of flashtube radiation required is much less than that required for a normal photographic flash exposure. One such application involves camera focusing, and the use of electronic strobe flash apparatus for determining the distance from a camera to the subject to be photographed. In this application, an electronic strobe flash unit can be used to transmit a short-duration pulse of radiation. The intensity of radiation reflected from the scene to be photographed is related to scene distance in a known manner. In an application for focusing a camera in which a pulse of IR radiation is transmitted by an electronic strobe flash unit, the electrical energy required to fire the flashtube is on the order of only about 0.1 joule.

A DC to DC converter for use in an electronic strobe flash unit requires a relatively large number of electrical components. The cost of the converter and flash-firing capacitor is a large portion of the overall cost of an electronic strobe flash unit. Furthermore, a converter can require a long interval to charge the capacitor to the voltage necessary to fire the flashtube. Accordingly, a conventional electronic strobe flash unit powered by a low-voltage battery and adapted for illuminating a scene is not ideally suited to an application that requires only a low level of flash radiation.

In addition, a DC to DC converter for use in an electronic strobe flash unit places a heavy load on the flash unit battery. This load can significantly alter the battery voltage, and the voltage to which the flash-firing capacitor is charged. Therefore, the amount of electrical energy to be delivered to the flashtube, and, accordingly the amount of flashtube radiation to be emitted, can vary as a function of battery voltage.

When an electronic strobe flash unit is used to determine subject distance, it is highly desirable that the amount of flash radiation be accurately regulated. In order that the flash illumination does not vary with battery voltage, it is necessary that voltage-monitor apparatus be provided for regulating the flash-firing capacitor voltage. Such apparatus makes an electronic strobe flash unit having a DC to DC converter additionally complex and adds further to the cost of the flash unit.

SUMMARY OF THE INVENTION

A simplified energy-regulating firing circuit for a battery-powered electronic strobe flash unit, which has a flashtube energizable by a voltage that is greater than the battery's voltage, includes a transformer having a primary winding connectable to the battery, and a secondary winding connected to the flashtube for supplying an energizing voltage to the flashtube. The transformer stores energy when the primary winding is connected to the battery, and the secondary winding delivers the stored energy to the flashtube when the primary is disconnected from the battery. Switch means, connected to form a series circuit with the primary winding and the battery, has (1) a first condition for connecting the battery to the primary winding to cause a predetermined amount of energy to be stored in the transformer, and (2) a second condition for disconnecting the battery from the primary winding, thereby causing the secondary winding to deliver a substantially constant amount of energy to the flashtube so that a substantially constant amount of flashtube radiation is produced each time the switch means is actuated.

The invention, and its advantages, will become more apparent in the detailed description of preferred embodiments presented below.

DESCRIPTION OF THE DRAWING

In a detailed description of preferred embodiments of the invention presented below, reference is made to the accompanying drawing, in which.

DESCRIPTION OF THE PREFERRED EMBODIMENTS

Because electronic strobe flash units are well known, the present description will be directed in particular to elements forming part of, or cooperating more directly with, apparatus in accordance with the present invention. It is to be understood that flash unit elements not specifically shown or described may take various forms well known to those having skill in the art.

Figure 1:
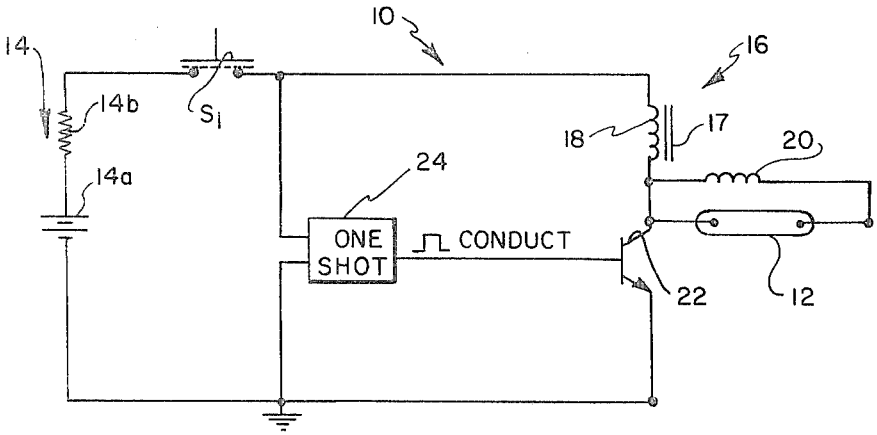
FIG. 1 is a circuit diagram of one preferred embodiment for firing electronic strobe flash apparatus.
Figure 2:
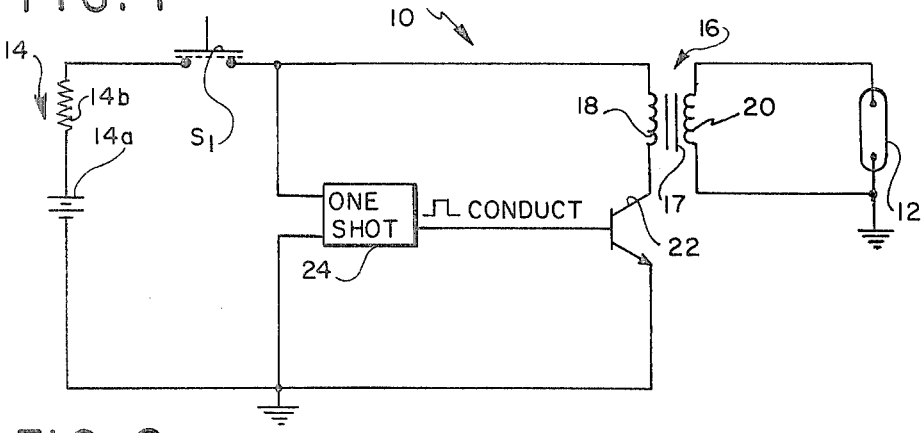
FIG. 2 is a circuit diagram of an alternate preferred embodiment for firing electronic strobe flash apparatus.
Figure 3:
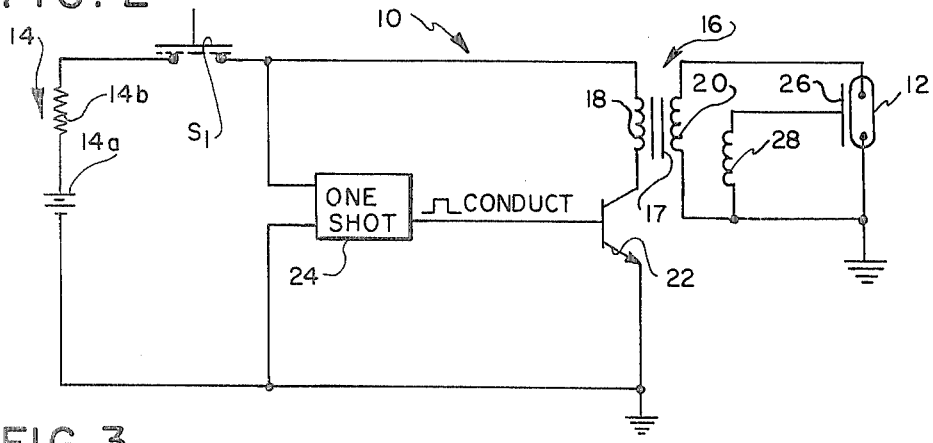
FIG. 3 is a circuit diagram of a further alternate preferred embodiment for firing electronic strobe flash apparatus.

There is shown in FIGS. 1, 2 and 3 a battery-powered electronic strobe flash unit 10 having an energizable flashtube 12. The flashtube 12 contains an ionizable gas such as xenon. The gas is ionized when a high voltage, termed the flashtube-breakdown voltage, is applied across the flashtube 12. When the gas is ionized, a firing current flows through the flashtube 12, thereby causing the flashtube to emit a pulse of radiation, which includes infrared (IR) and visible light.

The electronic strobe flash unit 10 is electrically powered by a low-voltage battery 14. As shown in the drawing, the battery 14 is represented as having an open-circuit voltage 14*a*, and an effective internal resistance 14*b*. The term "low-voltage battery" as used herein shall mean and refer to a battery having an open-circuit voltage that is less than the breakdown voltage of the flashtube 12.

A transformer 16 has a magnetic core 17, a primary winding 18 connected in series to the battery 14 through a momentary switch $S_1$, and a secondary winding 20 connected to the flashtube 12. A power-switching NPN transistor 22 is connected to form a series circuit with the primary winding 18, the momentary switch $S_1$, and the battery 14. The transistor 22 is arranged so that when it conducts, current flows from the battery 14 through the switch $S_1$, the primary winding 18, and the transistor to ground, and when it is non-conductive, battery current is prevented from flowing in the primary winding 18.

When battery current flows in the primary winding 18, a magnetic field builds in the core 17 that is directly proportional to the square of the primary winding current. When the magnetic field is building, the energy stored in the transformer's core equals $\frac{1}{2}$ $LI^2$ where L is the inductance of the primary winding 18 and I is the primary winding current.

When current in the winding 18 is terminated, the magnetic field in the core 17 is no longer sustained, and thereby collapses. The voltages across the transformer windings 18 and 20 are equal to the number of turns in their respective windings times the rate of change of the transformer's magnetic field. The transformer 16, including the number of turns in the secondary winding 20, is selected so that the voltage across the secondary winding is sufficient for energizing the flashtube 12, only when battery current is terminated in the primary winding 18. In that regard, the transistor 22 is adapted to switch from its conductive state into its non-conductive state sufficiently fast to allow the magnetic field in the core 17 to collapse rapidly so that the voltage induced across the secondary winding 20, when battery current is terminated, exceeds the flashtube-breakdown voltage.

A conventional one-shot multivibrator 24 switches the transistor 22 between its non-conductive state and its conductive state. The one-shot 24 produces a CONDUCT pulse in response to the closing of the switch $S_1$. As long as the pulse CONDUCT is present, the transistor 22 is in its conductive state and when the pulse CONDUCT terminates, the transistor switches into its non-conductive state.

If the condition of the battery 14 changes due, for example, to battery aging, the battery open-circuit voltage 14*a* can decrease, and/or the battery internal resistance 14*b* can increase, thereby limiting the current that the battery can supply. In the absence of a major deterioration in the condition of the battery 14, the one-shot 24 is arranged so that the duration of the pulse CONDUCT is sufficient to cause the core 17 of the transformer 16 to saturate with magnetic energy when battery current flows. The core 17 is saturated so that the transformer 16 can store the maximum amount of energy. The transformer 16 is also caused to saturate so that a regulated given amount of energy is available for firing the flashtube 12. In doing so, the flashtube 12 can emit substantially the same amount of radiation from one flashtube firing to the next.

Referring specifically to FIG. 1, the transformer 16 is in the form of an auto-transformer in which the primary winding 18 is connected in series between the momentary switch $S_1$ and the collector electrode of the transistor 22, and the secondary winding 20 is connected to the junction between the primary winding 18 and the transistor 22, parallel to the flashtube 12.

Alternate embodiments of the invention are shown in FIGS. 2 and 3. Components and circuits, shown in FIGS. 2 and 3, that correspond to components and circuits, respectively, shown in FIG. 1, are identified by like reference numerals. In the apparatus of FIG. 2, the secondary winding 20 is isolated from the primary winding 18, as shown.

In the apparatus of FIG. 3, the flashtube 12 has an external trigger electrode 26, and the transformer 16 has in addition to the primary winding 18 and the secondary winding 20, an additional secondary winding, denoted by the numeral 28. One terminal of the secondary winding 28 is connected to the trigger electrode 26 and the other terminal of the winding 28 is connected to the ground terminal of the flashtube 12.

The secondary winding 28 is arranged to generate a voltage pulse, in response to the termination of battery current in the primary winding 18, for causing initial ionization of the gas in the flashtube 12. The secondary winding 20 is arranged to provide a voltage, in response to the termination of battery current, that is required to sustain ionization of the flashtube gas. Because the voltage required to sustain ionization of the flashtube gas is smaller than the voltage required to initiate ionization, the number of turns in the secondary winding 20 can be less than the number of turns in the secondary winding 28.

Having described generally the construction of the apparatus of the invention, the operation of such apparatus is next described. The assumption is made that the battery 14 is in place and the momentary switch $S_1$ is initially open. In this condition, the transistor 22 is in its non-conductive state and no battery current flows in the primary winding 18.

The switch $S_1$ is closed in response to actuation of a shutter release member (not shown), which can be located on the body of a camera (also not shown) so as to be accessible to a camera operator. The one-shot 24, in response to the closing of the switch $S_1$, produces the pulse CONDUCT. The switch $S_1$ is arranged to remain in its closed position for an interval that is greater than the duration of the pulse CONDUCT.

The transistor 22, in response to the pulse CONDUCT, switches from its non-conductive state into its conductive state, and battery current begins to flow through the primary winding 18. This current is limited by the battery open-circuit voltage 14*a* and the resistance of the primary winding circuit including the battery internal resistance 14*b*, the resistance of the winding 18, and the resistance of the transistor 22. The primary winding current increases exponentially with time towards its limiting value at a rate determined by the inductance of the primary winding 18 divided by the resistance of the primary winding circuit.

As the current in the winding 18 increases and the magnetic field builds in the core 17, voltages are generated across the primary winding 18 and the secondary winding 20. The voltage across the secondary winding is the greater of the two voltages, and is proportional to the voltage across the primary winding 18 times the ratio of the number of turns in the secondary winding 20 to the number of turns in the primary winding.

When battery current flows in the primary winding 18, the voltage generated across the secondary winding 20 does not exceed the breakdown voltage of the flashtube 12. Accordingly, the flashtube 12 is not ionized, and no current flows in the secondary winding circuit, which consists of the secondary winding 20 and the flashtube 12.

The core 17 saturates when the primary winding current increases to a sufficiently high level. The apparent inductance of the primary winding 18 is zero so that increasing battery current does not produce additional magnetic energy in the core 17.

In the absence of major deterioration in the condition of the battery 14, the battery supplies sufficient current to saturate the core 17. Accordingly, the maximum amount of energy stored in the core 17 is solely a function of the energy storage capacity of the transformer 16 and is independent of changes in the battery voltage 14*a* and/or the battery resistance 14*b*.

When the pulse CONDUCT terminates, the transistor 22 switches back into its non-conductive state, thereby terminating the current in the primary winding 18. The magnetic field in the core 17 is no longer sustained by the current in the primary winding 18, and thereby collapses.

In the embodiments of FIGS. 1 and 2, when the magnetic field starts to collapse, the voltage induced across the transformer winding 20 exceeds the breakdown voltage of the flashtube 12. The gas in the flashtube 12 becomes ionized, thereby firing the flashtube.

A firing current flows in the secondary winding 20, in response to the ionizing of the flashtube gas, through the flashtube 12, thereby causing a pulse of radiation. The transformer's magnetic field decreases as the secondary winding 20 supplies the firing current to the flashtube 12. As this occurs, the voltages across the transformer's windings 18 and 20 decrease. Once the voltage across the winding 20 decreases below a minimum value, which is necessary to maintain ionization of the flashtube gas, current ceases to flow through the flashtube 12, thereby terminating the emission of flashtube radiation.

In the embodiment of FIG. 3, when the pulse CONDUCT terminates to interrupt battery current in the primary winding 18, the voltage initially induced across the secondary winding 28 is greater than the breakdown voltage of the flashtube 12, and the gas in the flashtube is ionized.

When the gas in the flashtube 12 is ionized, the voltage induced across the secondary winding 20, although less than the flashtube-breakdown voltage, is large enough to sustain ionization of the flashtube gas. Accordingly, when the voltage pulse across the secondary winding 28 ionizes the flashtube gas, an inductive current flows in the secondary winding 28 through the flashtube 12, thereby producing a main pulse of radiation.

The invention has been described in detail with reference to the Figures; however, it will be appreciated that variations and modifications are possible within the spirit and scope of the invention.

What is claimed is:

1. Electronic strobe flash apparatus adapted to be energized by a battery, said flash apparatus comprising:

(a) a flashtube energizable to produce radiation in proportion to the energy delivered to said flashtube;

(b) a transformer comprising a primary winding connectable to the battery, a secondary winding connected to said flashtube, and a core adapted to store magnetic energy in correspondence with current flowing into said transformer, said secondary winding being adapted to convert this stored energy into electrical energy and to deliver the same to said flashtube in response to the terminating of current into said transformer;

(c) actuatable switch means having (1) a first condition, occurring in response to the actuating of said switch means, for connecting said primary winding to the battery, and (2) a second condition for disconnecting said primary winding from the battery; and (d) bistable means having (1) a first state, occurring in response to said switch means assuming its first condition, for causing battery current to flow into said transformer, thereby causing said core to store magnetic energy, and (2) a second state, occurring a predetermined interval after said bistable means assumes its first state, for terminating battery current into said transformer, said bistable means being adapted to cause a predetermined amount of magnetic energy to be stored in said core so that an approximately constant amount of energy is delivered to said flashtube each time said switch means is acutated.

2. Electronic strobe flash apparatus adapted to be energized by a battery, said flash apparatus comprising:

(a) a flashtube energizable for conducting current to produce a pulse of radiation;

(b) transformer means comprising a primary winding coupled to the battery, a secondary winding coupled to said flashtube to form a firing circuit for flashing said flashtube with current in said secondary winding, and a core adapted to store a predetermined maximum amount of magnetic energy when a given level of battery current flows into said primary winding;

(c) switch means, connected in series to said primary winding and the energizing battery, and having (1) a first condition for causing battery current to flow into said primary winding to store magnetic energy in said core in correspondence with battery current, and (2) a second condition for terminating battery current into said primary winding to convert the energy stored in said core to a flashtube-energizing voltage across said secondary winding; and (d) a multivibrator, coupled to said switch means, having (1) a first state for maintaining said switch means in its first condition, and (2) a second state for maintaining said switch means in its second condition, said multivibrator being arranged to maintain said switch means in its first state for an interval which is sufficient to store the maximum amount of magnetic energy in said core;

(e) said secondary winding being adapted to convert the energy stored in said core into (1) a voltage for energizing said flashtube, and (2) a current to be conducted by said flashtube, in response to the interruption of battery current in said primary winding, whereby the electrical energy delivered to said flashtube is regulated in accordance with the energy storage capacity of said core to produce a given amount of flashtube radiation.

* * * * *